US006854488B2

(12) United States Patent
Hay et al.

(10) Patent No.: US 6,854,488 B2
(45) Date of Patent: Feb. 15, 2005

(54) FABRICS WITH PAIRED, INTERCHANGING YARNS HAVING DISCONTINUOUS WEAVE PATTERN

(75) Inventors: Stewart Lister Hay, Ramsbottom Bury (GB); Johann Boeck, Neufelden (AT)

(73) Assignee: Voith Fabrics Heidenheim GmbH & Co., KG, Heidenheim (DE)

( * ) Notice: Subject to any disclaimer, the term of this patent is extended or adjusted under 35 U.S.C. 154(b) by 211 days.

(21) Appl. No.: 10/329,131

(22) Filed: Dec. 24, 2002

(65) Prior Publication Data

US 2004/0118473 A1 Jun. 24, 2004

(51) Int. Cl.[7] ..... D21F 1/00

(52) U.S. Cl. ..... 139/383 A; 139/383 AA; 139/383 R; 162/903

(58) Field of Search ..... 139/383 R, 383 A, 139/383 AA; 162/903; 442/203

(56) References Cited

U.S. PATENT DOCUMENTS

| | | | | |
|---|---|---|---|---|
| 4,379,735 A | | 4/1983 | MacBean | |
| 4,501,303 A | | 2/1985 | Osterberg | |
| 5,152,326 A | | 10/1992 | Vohringer | |
| 5,437,315 A | | 8/1995 | Ward | |
| 5,454,405 A | * | 10/1995 | Hawes | 139/383 A |
| 5,826,627 A | | 10/1998 | Seabrook et al. | |
| 5,881,764 A | * | 3/1999 | Ward | 139/383 A |
| 5,967,195 A | * | 10/1999 | Ward | 139/383 A |
| 6,145,550 A | | 11/2000 | Ward | |
| 6,202,705 B1 | * | 3/2001 | Johnson et al. | 139/383 A |

FOREIGN PATENT DOCUMENTS

| | | |
|---|---|---|
| EP | 0 269 070 B1 | 3/1993 |
| WO | WO 02/14601 A1 | 8/2001 |

* cited by examiner

*Primary Examiner*—Danny Worrell
*Assistant Examiner*—Robert H. Muromoto, Jr.
(74) *Attorney, Agent, or Firm*—Caesar, Rivise, Bernstein, Cohen & Pokotilow, Ltd.

(57) ABSTRACT

A composite fabric comprising a paper side layer, a machine side layer and a plurality of pairs of first and second intrinsic, interchanging weft yarns having at least two segments in the paper side layer within each repeat of the weave pattern. Each layer comprises warp yarns and weft yarns woven together and having a predetermined repeat of the weave pattern in the cross-machine-direction. The first and second intrinsic, interchanging weft yarns in at least some of the plurality of pairs cooperating with each other to provide a discontinuous weft path in the paper side layer within each repeat of the weave pattern. Each pair of interchanging yarns that provides a discontinuous weft path in the paper side layer is positioned between two adjacent top weft yarns of the paper side layer, and each of the two adjacent top weft yarns cooperates with a different yarn of the interchanging yarn pair between the adjacent top weft yarns to define a continuous weft path within each repeat of the weave pattern of the fabric.

13 Claims, 2 Drawing Sheets

FABRICS WITH PAIRED, INTERCHANGING YARNS HAVING DISCONTINUOUS WEAVE PATTERN

FIELD OF THE INVENTION

The present invention relates generally to fabrics with paired, interchanging yarns, and more particularly, to fabrics employed in web forming equipment, such as papermaking and non-woven web forming equipment. More particularly, the preferred fabrics of this invention are employed as forming fabrics in web forming equipment.

BACKGROUND OF THE INVENTION

Papermaking involves the forming, pressing and drying of cellulosic fiber sheets. The forming process includes the step of depositing an aqueous stock solution of the fibers, and possibly other additives, onto the forming fabric upon which the initial paper web is formed. The forming fabric may run on a so-called Gap Former machine in which the aqueous stock initially is dewatered, and the initial paper sheet is formed between two forming fabrics.

An effective forming process typically produces a sheet with a very regular distribution of fibers and with a relatively high solids content, i.e., a high fiber-to-water weight ratio. In order to form a fibrous web with a desired uniform, regular distribution and high fiber-to-water weight ratio, the forming fabric must possess a number of properties. First, the papermaking surface should be relatively planar; resulting from the yarn floats in both the machine direction (MD) and cross-machine-direction (CD) lying at substantially the same height, to thereby prevent localized penetration of the fibers into the fabric. Such localized penetration results in "wire marks" which actually are the result of fiber density variations throughout the sheet area. In addition, the MD and CD floats need to be distributed in a regular manner to avoid introducing undesired wire marks into the formed sheet. Moreover, these basis weight variations can result in undesired variations in sheet absorption properties; a property very relevant to the functionality of quality graphical papers where a consistent uptake of print ink is necessary to produce a clear sharp image.

Other factors also cause the formation of undesired wire marks. For example, wire marks can be introduced into the sheet by the flow of water around yarns positioned below the fabric's papermaking surface. This phenomena, referred to as "strike through," needs to be taken into account in designing the fabric construction.

Importantly, the forming fabric must also possess a high degree of dimensional stability. This high stability is necessary, for example, to minimize cyclic variations in fabric width, which can result in MD wrinkles in the formed paper web. This, in turn, contributes to the so-called, streaky sheet, i.e., a sheet with machine direction streaks created by variations in fiber density.

Dimensional stability of a fabric typically is obtained by manufacturing the forming fabric with a relatively high mass of material. However, the use of thick yarns to establish high mass often causes undesirable wire marks. Consequently, there has been a trend to providing composite forming fabrics, that is, "multi-layer" structures, whereby a high number of relatively thin yarns are distributed throughout various fabric layers to facilitate fabric stability.

One type of multi-layer fabric is a triple-weft fabric made by interlacing one machine direction yarn system with three (3) cross-direction yarn systems. Such a fabric structure is taught in U.S. Pat. No. 4,379,735, issued to McBean. The three cross-direction yarn systems are arranged so that one system interlaces with the machine direction yarn system to form the paper side of the fabric; one system interlaces with the machine direction yarn system to form the wear side of the fabric, i.e., the side in contact with the paper machine dewatering elements, e.g., vacuum boxes, and the third cross-direction yarn system interlaces with the machine direction yarn system while at all times being positioned vertically between the paper side cross-direction yarn system above and the wear side cross-direction yarn system below. Accordingly, in all the triple-weft fabrics the same machine direction yarns interlace with both the paper side and wear side cross-direction yarn systems. This results in the machine direction yarns forming part of the fabric's paper side and wear side surfaces. This triple-weft fabric system requires a significant compromise in choice of MD and CD yarn diameters to attempt to meet the different requirements of the paper side and wear side surfaces of the forming fabric. However, the triple-weft structure does provide a very high CD bending stiffness and with it the ability to reduce sheet basis weight profiles.

Another type of multi-layer structure is a triple-layer fabric made by joining two (2) distinct fabrics, each with their own machine direction (warp) yarns and cross-direction (weft) yarns, by the use of additional and independent "binding yarns." These binding yarns can be employed in either the machine direction or cross-machine-direction, and in this system provide the sole function of binding the two separate fabrics together. In other words, these binding yarns are not intended to function as part of the warp or weft yarn system in either the top fabric or the bottom fabric of the multi-layer structure. Such a triple-layer fabric is illustrated in EP 0,269,070(JWI Ltd.).

Where the two fabrics of the triple-layer structure are joined in either the machine direction or cross-machine-direction by binding yarns that also belong, or form part of the weave pattern of either, or both, the paper side or wear side fabrics, the resulting structures are referred to more specifically as "self-stitched" triple-layer structures. Such binding yarns are referred to as "intrinsic binding yarns." Self-stitched structures are taught in a number of prior art patents. For example, U.S. Pat. No. 4,501,303 (Nordiskafilt AB) discloses a triple-layer structure wherein paper side yarns are used to bind the paper side and wear side fabrics into one structure.

Triple-layer structures, whether employing separate and distinct binding yarns or intrinsic binding yarns that form part of the paper side and/or wear side weave structure, allow, to some extent, for the use of fine machine direction and cross-machine-direction yarns in the paper side fabric for improved papermaking quality and sheet release. In addition, significantly coarser yarns can be employed in the lower fabric, or wear side fabric, which contacts the paper machine elements, to thereby provide good stability and fabric life. Thus, these triple-layer structures have the capability of providing optimum papermaking properties in the paper side fabric and optimum strength properties in the wear side layer. However, in comparison with the aforementioned triple-weft structures, in the triple-layer structures the CD bending stiffness is reduced; thereby reducing the ability to minimize sheet basis weight profiles.

A variety of composite fabrics employing intrinsic interchanging yarn pairs have been disclosed to attempt to deal with the various problems of fabric strength, fabric stability e.g., fabric stiffness, desired paper side performance and desired wear side performance. In particular, various different composite fabric constructions are disclosed in U.S. Pat. No. 4,501,303 (Osterberg); U.S. Pat. No. 5,152,326 (Vochringer); U.S. Pat. No. 5,826,627 (Seabrook et al.); U.S. Pat. No. 5,967,195 (Ward); U.S. Pat. No. 6,145,550 (Ward) and International Publication WO 02/14601 A1 (Andreas Kufferath GMBH&Co. KG). In all of these structures, all of the interchanging yarn pairs cooperate to provide an uninterrupted or continuous weave pattern in each repeat of the fabric weave pattern of the paper side layer; preferably a continuous plain weave structure. The continuous, uninterrupted plain weave pattern in prior art structures is established by one yarn of the pair moving out of the paper side layer on one side of a single, paper side warp transition yarn and the other yarn of the pair moving into the paper side layer on the opposite side of the single warp transition yarn.

If there were two or more contiguous paper side warp transition yarns between the location where one yarn of the pair moves out of the paper side layer and the other yarn of the pair moves into the paper side layer the plain weave pattern provided in each segment of the paper side layer by each respective yarn of the pair would be interrupted, or rendered discontinuous at the interchange location. Likewise, if one yarn of the pair overlies the other yarn of the pair in the paper side layer without the provision of a paper side warp transition yarn, then the plain weave pattern also is interrupted, or rendered discontinuous.

U.S. Pat. No. 5,437, 315, issued to Ward, discloses a triple-layer fabric having both a top fabric layer and a bottom fabric layer, each including machine direction yarns interwoven with cross-machine-direction yarns. Weft binder yarns, which have a number of top weft yarns between each successive pair, are spaced-apart from each other in the machine direction, extend generally parallel with the cross-machine-direction yarns of the top fabric layer and the bottom fabric layer and interweave with the top fabric layer and bottom fabric layer. In the disclosed structures, each of the spaced-apart binder yarns replaces a cross-machine-direction yarn of the top fabric layer when the binder yarn engages one or more machine direction yarns of the top fabric layer.

The requirement in prior art structures that the interchanging yarn pairs provide a continuous weave pattern imposes limitations on establishing the desired fabric stiffness of the fabric whilst maintaining sufficient openness of the fabric's paper side surface to allow for the passage of the required amount of water at optimal machine running speeds.

Although the aforementioned composite papermaking fabrics employing intrinsic interchanging yarn pairs have provided improved structures, applicants believe that there still is a need for additional, improved composite structures of the type employing intrinsic interchanging yarn pairs having a desired balance of sheet dewatering properties, high resistant to layer delamination and stability for sheet basis weight control. It is to such structures that the present invention is directed.

SUMMARY OF THE INVENTION

The above and other objects of this invention are obtained in composite forming fabrics having a paper side layer with a paper side surface, a machine side layer having a bottom wear side surface and a plurality of pairs of first and second intrinsic interchanging yarns. Reference throughout this application to "intrinsic interchanging yarns" or "interchanging yarns" means yarns that form a part of the weave structure in at least one segment of the paper side layer of the composite fabric within each repeat of the weave pattern.

In accordance with this invention, the paper side layer and the machine side layer each comprise machine direction warp yarns and non-interchanging cross-machine-direction weft yarns woven together. In addition, the fabrics of this invention include a plurality of pairs of first and second interchanging yarns having at least two (2) segments in the paper side layer within each repeat of the weave pattern. A segment is herein defined as a portion of the complete fabric repeat pattern. For example, if there are ten paper side warp yarns in the weave repeat of the fabric and the paper side weave is a plain weave, then a weft yarn can provide a segment by weaving over a warp yarn to make a weft knuckle visible on the surface of the paper side layer.

In this invention, unlike the prior art, the pair of yarns in at least some, and preferably all of the interchanging binder yarn pairs cooperate to provide a discontinuous weft path in the paper side layer. That is, the adjacent segments provided by the two interchanging yarns in the pairs have gaps between them and/or overlap to create the discontinuity. In accordance with all of the embodiments of this invention each pair of interchanging binder yarns that provides a discontinuous weft path in the paper side layer is positioned between two adjacent top weft yarns that have a weave pattern with the top warp yarns such that one of the two adjacent top weft yarns cooperates with one yarn of the pair of adjacent interchanging binder yarns to define a continuous weft path within each repeat of the weave pattern of the fabric and the other of the two adjacent top weft yarns, which is on the other side of the pair of interchanging binder yarns, cooperates with the other yarn of that adjacent pair of interchanging binder yarns to define a continuous weft path within each repeat of the weave pattern.

One yarn of each pair of interchanging binder yarns having a discontinuous weft path interlaces with (i.e., over) at least some warp yarns of a first group that are positioned alternately with warp yarns of a second group. The other yarn of each such pair of interchanging binder yarns interlaces with (i.e., over) at least some of the warp yarns of the second group. In a preferred embodiment, both yarns in each pair of interlacing binder yarns follow the same weave path from the paper side layer to the wear side layer, but are shifted transversely relative to each other; both of such yarns having the same number of paper side and wear side interlacings within each repeat with no reversing of the insertion order from pair to pair. In other preferred embodiments, both yarns in each pair of interlacing binder yarns follow different weave paths from the paper side layer to the wear side layer; are shifted transversely relative to each other; and both of such yarns have a different number of paper side and/or wear side interlacings within each repeat, such that reversing of the insertion order from pair to pair may be possible.

In accordance with this invention the interchanging binder pairs having a discontinuous weft path arc not included between all adjacent top weft yarns. Top weft yarns that are not adjacent an interchanging binder pair having a discontinuous weft path have a continuous weave pattern; preferably but not limited to a plain weave pattern. This continuous weave pattern preferably is the same as the continuous weave pattern provided by the reaction of the weave pattern of each yarn of a pair of interchanging yarns having a discontinuous weft path with its corresponding adjacent top weft yarn. "Intrinsic weft binder yarns" are weft yarns that are part of the weave structure of the paper side surface of the paper side layer and also serve to bind together the paper side layer and machine side layer within each repeat of the weave pattern. Thus, each intrinsic weft binder yarn of each pair of first and second intrinsic weft binder yarns, whether providing a continuous or discontinuous weave pattern in each repeat, provides two functions within each repeat of the weave pattern. One function is to contribute to the weave structure of the paper side surface of the paper side layer, and the second function is to bind together the paper side layer and the machine side layer.

In accordance with this invention some of the interchanging yarn pairs also can be intrinsic top weft/binder yarn pairs and/or top weft/top weft pairs; each of such latter pairs preferably cooperating to provide a continuous weave pattern in the paper side layer within each repeat.

Reference throughout this application to "intrinsic top weft/binder yarn pair" means a pair of yarns wherein one yarn of the pair; namely the binder yarn of the pair, forms the weft path in the paper side surface of the paper side layer in at least one segment of each repeat of the weave pattern and then drops down to encircle at least one warp yarn in the machine side layer in either a transition region or in a region underlying at least another segment, wherein said at least another segment may be adjacent to or spaced from said at least one segment depending, in part, on the number of segments within each repeat of the weave pattern in the paper side layer. The top weft yarn of the top weft/binder yarn pair forms the weft path in a segment in the paper side layer within each repeat of the weave pattern that is not occupied by the binder yarn of the pair, and then drops out of the paper side layer to float between the paper side layer and machine side layer in one or more other segments within each repeat of the weave pattern, without in any way binding the paper side layer to the machine side layer. A "top weft/binder yarn pair" is illustrated in FIG. 2(*b*) of International Publication No. WO 02/14601, the subject matter of which is incorporated herein by reference.

As used throughout this application, reference to "weft yarn/weft yarn pair" or "top weft yarn/top weft yarn pair" refers to a pair of intrinsic interchanging yarns wherein each yarn forms the cross direction weave path in alternate segments of the paper side surface and then drops down to float between the paper side layer and the machine side layer in the remaining segments within the repeat, and then, after floating between the paper side layer and machine side layer, moves back into the paper side layer to provide a continuation of the weft path in the fabric. One yarn of the weft yarn/weft yarn pair floats between the paper side layer and the machine side layer in a region underlying the segment in which the other weft yarn of the pair forms the weft path in the paper side surface, and then moves up into the paper side surface in an adjacent segment to form the weft path in that segment of the paper side surface overlying the portion of the other weft yarn of the pair that has moved out of the paper side layer to float between the paper side layer and machine side layer in such adjacent segment. Thus, the two weft yarns of each weft yarn/weft yarn pair cooperate to provide a continuous unbroken weft path across the paper side surface and also include segments that float between the paper side layer and the machine side layer to stiffen the fabric. Neither yarn of the weft yarn/weft yarn pair cooperates to bind the paper side layer and the machine side layer together.

DESCRIPTION OF THE PREFERRED EMBODIMENTS OF THE INVENTION

In the composite fabrics of this invention it is highly desirable to provide a homogeneous, or substantially continuous, unbroken weave pattern throughout the paper side surface thereof, while achieving desired cross-machine-direction stiffness or strength. In accordance with this invention, this is accomplished by the cooperation, or interaction between one or more interchanging yarn pairs and respective top weft yarns, adjacent to, and on opposite sides of each respective interchanging yarn pair. In particular, one yarn of each interchanging yarn pair cooperates with an adjacent, top weft yarn to provide a continuous, cross-machine direction weft path and the second interchanging yarn of the pair weaves in a manner to cooperate with the other adjacent, top weft yarn to also form a continuous cross-machine direction weft path. However, the two yarns of the aforementioned interchanging yarn pairs cooperate with each other to define a discontinuous, cross-machine-direction weft path.

Figure 1:
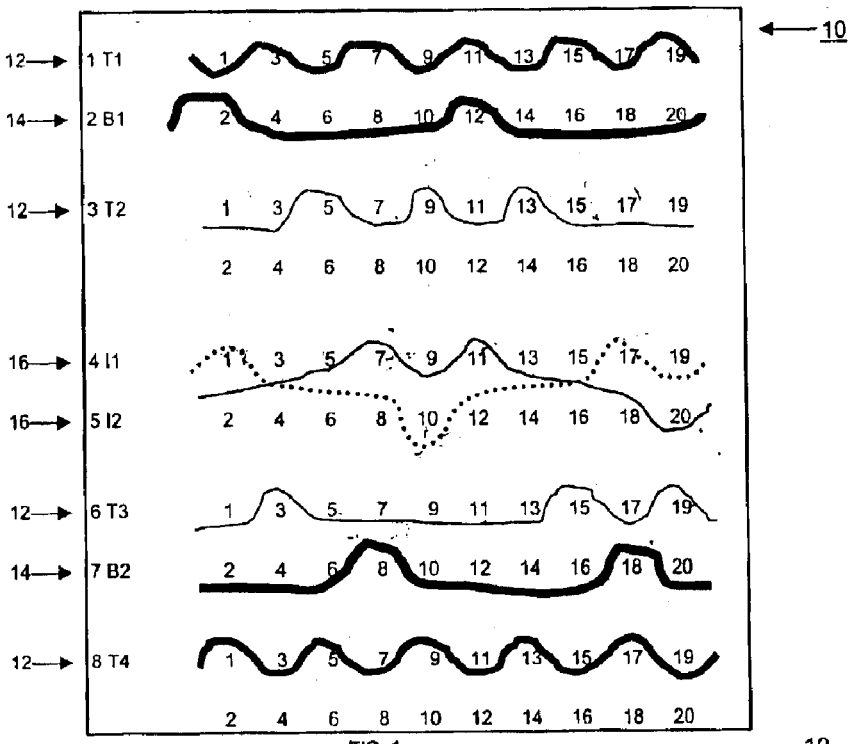
FIG. 1 illustrates a fabric weave pattern in accordance with this invention.

Referring to FIG. 1, a preferred embodiment of a fabric weave pattern in accordance with this invention, which is a 20 shed repeat, is partially illustrated at 10, i.e., 7 weft yarns of a total of 65 being shown. In this embodiment the fabric 10 includes a top layer 12 (e.g., including non-interchanging top weft yarns T1, T2 and T3), a bottom layer 14 (e.g., including non-interchanging bottom weft yarn B1 and B2), and a pair of interchanging, intrinsic weft binder yarns 16 (e.g., including interchanging weft yarns I1 and I2). The top layer, as illustrated, includes top warps 1, 3, 5, . . . , 19 interwoven with top weft yarns illustrated at T1, T2 and T3. In addition binder yarn I1 of the illustrated intrinsic binder yarn pair 16 cooperates with adjacent top weft yarn T2 to form a continuous weave pattern in the top layer 12, and the other binder yarn 12 of the illustrated intrinsic binder yarn pair 16 cooperates with the other adjacent top weft yarn T3 to form a continuous weave pattern in the top layer 12. Both of these latter continuous weave patterns, as illustrated, are plain weave patterns. That is binder yarn I1 and top weft yarn T2 cooperate to interweave over a first group of top warp yarns, that is top warp yarns 1 (I1), 5 (T2), 9 (T2), 13 (T2) and 17 (I1). Whereas binder yarn I2 and top weft yarn T3 cooperate to interweave over the alternating, or second group of top warp yarns, that is top warp yarns 3 (T3), 7 (I2), I1 (I2), 15 (T3) and 19 (T3).

Still referring to FIG. 1, in accordance with this invention the yarns I1, I2 of the pair of intrinsic weft binder yarns 16 cooperate with each other to provide a discontinuous weave pattern in the top layer 12 over the illustrated 20 shaft repeat. That is, the weave pattern has gaps at adjacent, or contiguous top warp yarns 3,5 and 13,15, disrupting the continuity of the plain weave pattern in the top layer 12. The adjacent top warp yarns 3, 5 arc paired transitional yarns under which I1 passes as it moves from the top layer 12 into the bottom layer 14 to bind with bottom warp yarn 10, and under which I2 passes as it moves from the bottom layer 14 to the top layer 12 to bind with the top warp yarns 7 and 11. Similarly, the adjacent top warp yarns 13, 15 are transitional yarns under which I2 passes to bind to bottom warp yarn 20, after interweaving with top warp yarns 7 and 11; and under which I1 passes to bind with top warp yarn 17 after binding with bottom warp yarn 10. As explained earlier herein, if the interchanging weft yarns of interchanging binder pairs interchanged positions by passing under only one transitional warp yarn in the top layer 12, the plain weave pattern formed by the interchanging weft yarns would be continuous, as is illustrated in the prior art, e.g., Seabrook, et al. U.S. Pat. No. 5,826,627.

Still referring to FIG. 1, top weft yarn T1, which is the only illustrated top weft yarn that is not adjacent a binder pair having a discontinuous weave pattern, forms a continuous, plain weave pattern in each repeat of the top layer 12. This is true for all other top weft yarns (not shown) that are not adjacent to an interchanging binder pair providing a discontinuous weave pattern over the weave repeat of the fabric. However, it is within the scope of this invention to replace at least some of such top weft yarns with interchanging yarn pairs that form a continuous weave pattern over each repeat, including binder yarn pairs; top weft/binder yarn pairs and/or top weft/top weft yarn pairs.

Finally, and still referring to FIG. 1, three (3) continuous weft paths are shown in the paper side layer, formed, respectively, by yarn T1, yarns T2 & I1 in combination with each other, and yarns I2 & T3 in combination with each other. The paper side, continuous weft path formed by the combination of weft yarns T2 & I1 is not superposed vertically above any wear side weft yarn, whereas the continuous paper side weft paths formed, respectively, by the combination of the other interchanging yarn pair I2, T3 and by the paper side weft T1 are vertically superposed over corresponding wear side weft yarns B2, B1, respectively. In effect a 2:1 ratio of paper side to wear side weft paths is obtained throughout the length of the fabric. In the paper side layer the continuous weft path formed by either a single weft yarn or by a pair of weft yarns acting in concert is considered as one single weft path.

Table 1 compares the properties of a fabric according to FIG. 1 of the invention with a fabric according to the prior art structures disclosed in FIGS. 1A and 1B of the Ward '195/'550 patents.

TABLE 1

| Property | Prior Art | Invention |
|---|---|---|
| Warp Diameter (mm) paper side/wear side | .14/.18 | .14/.18 |
| Weft Diameter (mm) paper side/wear side | .13/.27 | .13/.27 |
| Binder Diameter (mm) | 0.13 | 0.13 |
| Warp/cm (paper side/wear side) | 32.7/32.7 | 32.7/32.7 |
| Weft/cm (paper side/wear side) | 39.0/19.5 | 39.0/19.5 |
| Air permeability (cfm) | 367 | 370 |
| Fiber Support Index (FSI) | 188 | 188 |
| Paper side Open Area (projected) (%) | 26.6 | 26.6 |
| Bending Stiffness Ratio (CD) | 1.00 | 1.43 |

It can be seen from Table 1 that the respective yarn diameters were kept the same, as were the numbers of yarns per unit area. Note that for the invention to achieve the same number of paper side yarns, i.e. continuous weft paths, more yarns were actually woven on the loom.

It can be seen from Table 1 that the paper side surface of the invention gives the same level of fiber or sheet support as the prior art, as indicated by the equal Fiber Support Index (FSI) defined by Beran in Tappi, 62 (4), 39, 1979. Similarly the open area of the illustrated fabric of this invention is equivalent to the prior art, indicating that comparable removal of water is possible from the sheet being formed. This is reinforced by the equality of the permeability, or openness, of the two structures, as measured on a Frasier permeability tester at 0.5 inches of water pressure differential. The major difference between the prior art fabric and the illustrated fabric of this invention is the significantly higher CD bending stiffness achieved in the present invention —43% higher than the prior art fabric.

Figure 2:
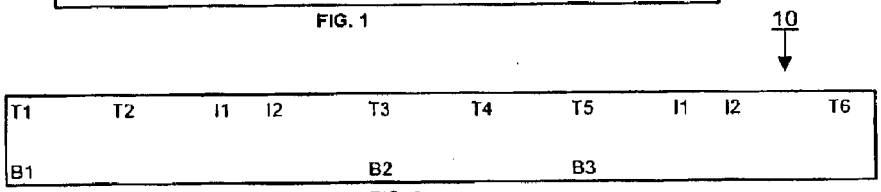
FIG. 2 is a stylized representation of one repeat weft sequence of the fabric weave pattern illustrated in FIG. 1.

Referring to FIG. 2, a stylized representation of one repeat weft sequence of the fabric 10, which is only partially represented in FIG. 1, is shown, i.e., a 13 weft sequence which repeats 5 times in the full fabric weave repeat. The portion of the representation in FIG. 2 that coincides with FIG. 1 is identified by the same letter-number designations, e.g., T1, T2, B1, B2, etc. As should be apparent, within each repeat only top weft yarns T1 and T4 are not adjacent an interchanging binder pair I1–I2 that provides a discontinuous weft pattern, and these latter top weft yarns T1, T4 preferably provide a continuous plain weave pattern in each repeat. If desired these top weft yarns T1, T4, or either of them, could be provided by an interchanging yarn pair (e.g., binder yarn pair, top weft/binder yarn pair and/or top weft/top weft yarn pair) that provides a continuous weave pattern, rather than by a single weft yarn. It also should be noted that there are three (3) adjacent top weft yarns (e.g., T3, T4, T5 and T6, T1, T2) between each binder yarn pair I1–I2 that provides a discontinuous weft path. Every other group of three adjacent top weft yarns e.g., T6, T1, T2 includes a continuous bottom weft e.g., B1 underlying the middle top weft yarn, e.g., T1 in that group, and the other alternating group of three adjacent top weft yarns, e.g., T3, T4 and T5 includes continuous bottom weft yarns B2, B3 underlying the end top weft yarns T3, T5 of such alternating group.

Figure 3:
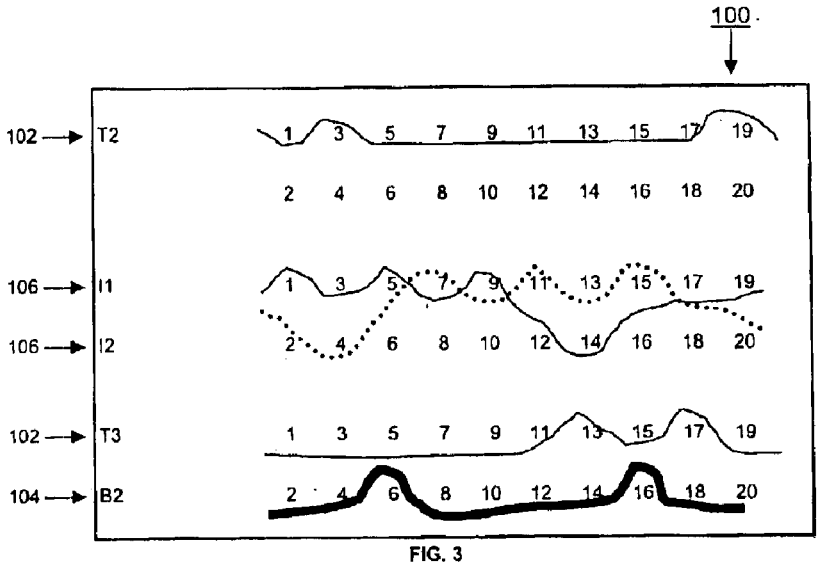
FIG. 3 illustrates a fabric weave pattern in accordance with another embodiment of this invention.

Referring to FIG. 3, a second embodiment of a fabric weave pattern in accordance with this invention, which also is a 20 shed repeat, is partially illustrated at 100. As will he explained in detail hereinafter, the second embodiment 100 employs interchanging binder yarn pairs 106 that provide a different discontinuous weft path than the binder yarn pairs 16 in the fabric 10.

The fabric 100 includes a top layer 102, a bottom layer 104 and interchanging, intrinsic weft binder yarn pairs 106. The top layer, as illustrated, includes top warps 1, 3, 5, . . . , 19 interwoven with top wefts illustrated at T2 and T3. In addition binder yarn I1 of the illustrated intrinsic binder yarn pair 106 cooperates with adjacent top weft yarn T2 to form a continuous plain weave pattern in the top layer 102, and the other binder yarn 12 of the illustrated intrinsic binder yarn pair 106 cooperates with the other adjacent top weft yarn T3 to form a continuous plain weave pattern in the top layer 102. That is binder yarn I1 and adjacent top weft yarn T2 cooperate to interweave over a first group of top warp yarns, that is top warp yarns 3 (T2), 7 (I1), 11 (I1), 15 (I1) and 19 (T2). Binder yarn I2 and adjacent top weft yarn T3 cooperate interweave over the alternating, or second group of top warp yarns, that is top warp yarns 1 (I2), 5 (I2), 9 (I2), 13 (T3) and 17 (T3). Thus, the cooperation of binder yarn I1 a yarn T2, and the cooperation of binder yarn I2 and top weft yarn T3 preserves the integrity of the plain weave pattern in each weave repeat.

Still referring to FIG. 3, in accordance with this invention the binder yarns I1, I2 of the pair of intrinsic binder yarns 106 provide a discontinuous weave pattern in the top layer 12 over the illustrated repeat, in a different fashion than the yarns I1, I2 of the pair of intrinsic binder yarns 16 in the fabric 10 illustrated in FIG. 1. That is, the discontinuous weave pattern has gaps at adjacent top warp yarns 17 and 19, which disrupts the continuity of the plain weave pattern in the top layer 12. In addition, the continuity is disrupted by the overlay of the intrinsic binder yarns I1 and I2 overlying and underlying contiguous top warp yarns 7 and 9, respectively. The adjacent top warp yarns 17, 19 are paired, transitional warp yarns under which I1 passes as it moves from the top layer 102 into the bottom layer 104 to bind with bottom warp yarn 24 (not shown), which is equivalent to bottom warp yarn 4, and under which I2 passes as it moves from the bottom layer 104 to the top layer 102 to bind with the top warp yarns 21, 25 and 29 (not shown), which arc equivalent to top warp yarns 1, 5 and 9.

Figure 4:
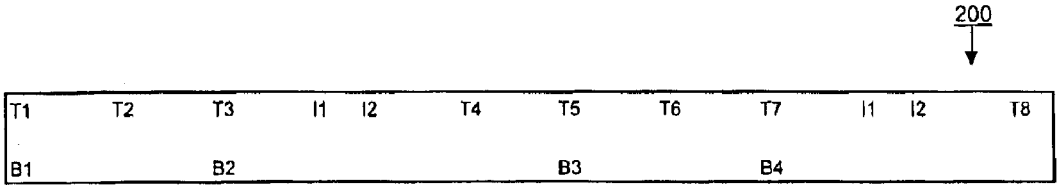
FIG. 4 is a stylized representation of one repeat weft sequence for a core block of weft yarns in accordance with an additional embodiment of this invention.

Referring to FIG. 4, a stylized representation of the repeat sequence for a core block of weft yarns of a further fabric of this invention is shown at 200. As can be seen in FIG. 4, the wear side, or bottom wefts B1, B2, B3 and B4 are positioned in groups of two (B1,B2 and B3,B4) relative to 4 paper side wefts (T8, T1,T2,T3 and T4,T5,T6,T7, respectively). Moreover, in the weft sequence for fabric 200, four adjacent top weft yarns (T8,T1,T2,T3 and T4,T5,T6,T7) are provided between adjacent pairs of interchanging binder yarns (I1, I2) that cooperate with each other to provide a discontinuous weft path. Thus, the two central top weft yarns T1,T2 and T5,T6, in each group of 4 adjacent top weft yarns, respectively, are not disposed adjacent an interchanging binder yarn pair providing a discontinuous weft path, and therefore weave a continuous weft path in each repeat; preferably a continuous plain weave. The top weft yarns adjacent opposite sides of each interchanging binder yarn pair that provides a discontinuous weft path (e.g., top weft yarns T3,T4 on opposite sides of one binder yarn pair I1,I2 and top weft yarns T7, T8 on opposite sides of the other binder yarn pair I1, I2) cooperate with the interchanging binder yarn pair to provide a continuous weft path in each repeat; preferably a plain weave. That is one of the interchanging yarns (e.g., I1) of a pair cooperates with one adjacent top weft yarn (e.g., T3) to provide a continuous weft path in each repeat, and the other interchanging yarn (e.g., I2) of the pair cooperates with the other adjacent top weft yarn (e.g., T4 ) to provide a continuous weft path in each repeat, as also was explained in detail in connection with FIG. 3.

As can be seen in both FIGS. 2 and 4, both fabrics 10 and 200 have a 2:1 paper side to wear side continuous weft path ratio in each repeat. That is, in the fabric 10 (FIG. 2), the ten (10) weft yarns which are present in the paper side layer combine to provide six (6) continuous weft paths (i.e., T1, T2-I1, T3-I2, T4 , T5-I1, T6-I2), and there are three (3) wear side B1, B2, B3 present to provide three (3) continuous wear side weft paths for each six (6) continuous paper side weft paths.

In the fabric 200 (FIG. 4), the twelve (12) yarns that are present on the paper side layer combine to provide eight (8) continuous weft paths (i.e., T1, T2, T3-I1, T4 -I2, T5 , T6, T7-I1, T8-I2), and there are four (4) wear side weft yarns B1, B2, B3, B4 present to provide four (4) continuous wear side weft paths for each eight (8) continuous paper side weft paths. Although the fabrics 10 and 200 both provide clothing with an effective continuous weft path ratio of 2 paper side for every 1 wear side, the proportion of actual yarns employed to form the effective continuous paper side weft paths in the fabric 10 (i.e., 6 effective continuous weft paths provided by 10 yarns —60%) is less than the proportion of actual yarns employed to form the continuous paper side weft paths in the fabric 400 (i.e., 8 effective continuous weft paths provided by 12 yarns —66.7%). Thus, in accordance with this invention a number of fabric properties can be varied while still maintaining the same ratio of effective paper side continuous weft paths/wear side continuous weft paths. In addition to fabrics having an effective paper side continuous weft path/wear side continuous weft path ratio of 2:1, the benefits and features of this invention also apply to fabrics having different ratios of effective paper side continuous weft paths/wear side continuous weft paths in each repeat, e.g., 1:1, 3:1, 3:2 and 4:3.

FIGS. 5–8, which will be discussed in detail hereinafter, depict different arrangements of interchanging binder yarn pairs providing discontinuous weft paths, which can be employed in the fabrics of this invention. In the fabrics employing each of the arrangements of interchanging binder yarn pairs depicted in FIGS. 5–8, the weave patterns of the top weft yarns adjacent opposite sides of each such interchanging, discontinuous binder yarn pair are adjusted to cooperate with the interchanging binder yarn pair to provide a continuous weft path in each repeat; preferably of a plain weave. That is, one adjacent top weft yarn cooperates with one of the yarns of the interchanging yarn pair to provide a continuous weft path in each repeat, and the other adjacent top weft yarn, on the other side of the interchanging yarn pair, cooperates with the other yarn of the interchanging yarn pair to provide a continuous weft path in each repeat; in the same manner as was explained in detail in connection with fabrics 10 and 100 illustrated in FIGS. 1 and FIG. 3, respectively.

Figure 5:
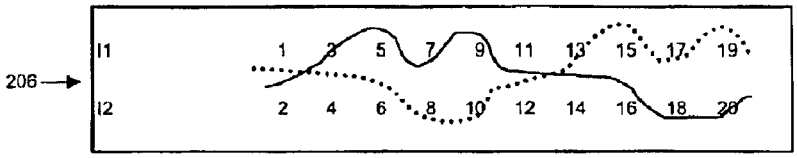
FIGS. 5–8 show different embodiments of discontinuous interchanging binder yarn pairs that can be employed in fabrics of this invention.

Now, turning to FIG. 5, a pair of interchanging binder yarns I1, I2 providing a discontinuous top weft path is depicted at 206, and is made up of individual, interchanging yarns I1 and I2. The depicted weave is a twenty (20) shaft weave, as in the fabric 10, and the discontinuity is created in the same way as in fabric 10. That is, within each repeat the yarns I1, I2 interchange positions by passing between two adjacent top weft yarn (1,3 and 11,13, respectively). The yarns I1, I2 in the illustrated pair of interchanging binder yarns 206 each interlace with two adjacent wear side warp yarns in each weave repeat (i.e., I1 interweaves, or interlaces, with adjacent wear side warps 8,10, and I2 interweaves, or interlaces, with adjacent wear side warps 18,20). This is in distinction to the fabrics 10 and 100, illustrated in FIGS. 1 and 3, wherein each binder yarn of each discontinuous interchanging binder yarn pair 16, 106 interlaces with only one wear side warp yarn.

Figure 6:
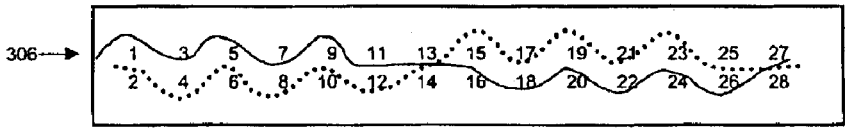

Turning now to FIG. 6, an interchanging binder yarn pair 306 providing a discontinuous top weft path is made up of interchanging weft binder yarns 11, 12 and is illustrated in a twenty-eight shaft weave repeat. Specifically, each of the interchanging yarns I1, I2 interlaces to provide knuckles underneath multiple (three each) non-adjacent wear side warp yarns (4,8,12 and 18,22,26, respectively), such that the free binder length within the fabric (i.e., between the paper side and wear side layers) is minimized. This ensures a low risk of layer delamination and keeps the layers bound in close proximity to minimize void volume for entraining water.

A further feature that can be observed in the interchanging binder yarn pair 306 is that each of the yarns I1, I2 binds to the wear side layer under both segments and transition zones. That is, the transition zones between segments, which is where the yarns I1, I2 interchange positions are in the regions underlying adjacent top warp yarns 11,13 and 25,27, respectively. Interchanging weft yarn I1, binds to wear side warp yarns 4 and 8, under a first top segment in which a top weave pattern is provided by weft binder yarn I2, and to wear side warp yarn 12 in the transition zone provided under top warp yarns 11, 13. Likewise, interchanging weft yarn I2 binds to wear side warp yarns 18, 22 under a second top segment in which a top weave pattern is provided by weft binder yarn I1, and to wear side warp yarn 26 in the transition zone provided by top warp yarns 25, 27.

Figure 7:
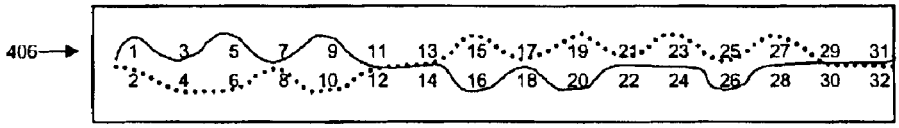

Turning now to FIG. 7, an interchanging binder yarn pair 406 providing a discontinuous top weft path is made up of interchanging weft binder yarns I1, I2 and is illustrated in a thirty-two shaft weave repeat. Each of the yarns I1, I2 interlace with multiple wear side warp yarns such that the free binder length within the fabric is minimized to ensure a low risk of layer delamination and to keep the layers bound in close proximity to minimize possible water carry in any void space. However, unlike the previously-disclosed embodiments, in this embodiment each of the binder yarns I1, I2 in the pair 406 follows a different weave path. In particular, binder yarn I1 makes four (4) paper side knuckles and interlaces on the wear side with single wear side warp yarn 10 and with adjacent wear side warp yarns 4 and 6 under one top segment. Binder yarn I2, however, makes only three (3) paper side knuckles and interlaces on the wear side to make 3 separate knuckles under warp yarns 16, 20, and 26 respectively, under a second top segment. Providing different paths for the interchanging yarns I1, I2, makes it possible to reverse the insertion order of the yarns of the interchanging yarn pairs within the weave repeat of the fabric. In an exemplary embodiment, the bottom weft yarns could have two, 8 shaft repeats.

Figure 8:
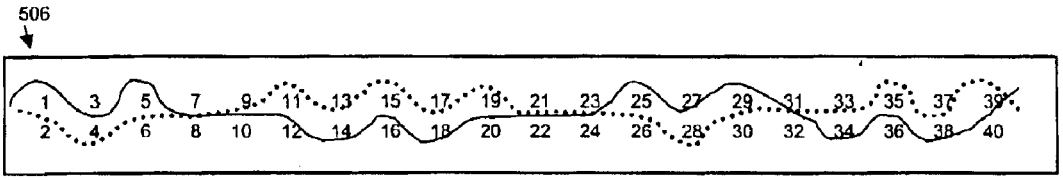

Turning now to FIG. 8, in another embodiment of this invention an interchanging binder yarn pair 506 providing a discontinuous top weft path is made up of interchanging weft binder yarns I1, I2 and is illustrated in a forty shaft weave repeat having a plain weave face. The wear side layer can include a five-shaft repeat. Yarn I2, depicted as a solid line, makes two top segments in the paper side layer, and forms two knuckles in each of said segments (over top warp yarns 1 and 5 in one segment and over top warp yarns 25 and 29 in the other segment). The yarn I1, depicted as a dotted line, makes 3 knuckles over top warp yarns 11, 15, 19 in one top segment and then makes 2 knuckles over top warp yarns 35 and 39 in a second top segment and then transitions between adjacent top warp yarns 39 and 1 to bind to wear side warp 4. Thus, the interchanging weft yarns I1, I2 in this binder yarn pair 406, unlike the yarns in the previously described binder yarn pairs, transitions between adjacent paper side warps. Important features of all embodiments of this invention are the following:

1. The fabrics include a plurality of interchanging binder yarn pairs that provide a discontinuous weft path in each repeat; resulting from the yarns in the interchanging yarn pairs having a number of transitional warp yarns between them that disrupts the continuity of the top weave pattern and/or resulting from the yarns in the interchanging yarn pairs overlapping each other;
2. One yarn of each interchanging binder yarn pair that provides a discontinuous weft path interlaces with top yarns of a first group of alternating top warp yarns that are positioned alternately with a second group of alternating top warp yarns, and the second yarn of each such interchanging binder yarn pairs interlaces with top warp yarns of the second group;
3. The interchanging binder yarn pairs providing the discontinuous weft path are not positioned between each adjacent pair of paper side weft yarns; and
4. Both weft yarns of each of the interchanging binder yarn pairs that provide a discontinuous weft path in each repeat either:
   a) follow the same weave path from the paper side to the wear side layer, but are staggered transversely relative to each other, and each of such interchanging binder yarn pairs has the same number of paper side and wear side interlacings such that there is no reversing of the insertion order from interchanging binder yarn pair to interchanging binder yarn pair or
   b) follow different weave paths from the paper side to the wear side layer, and are staggered transversely relative to each other, and each such interchanging binder yarn pair has a different number of paper side and/or wear side interlacings such that reversing of the insertion order from interchanging binder yarn pair to interchanging binder yarn pair can be made.

Fabrics of this invention, including the aforementioned four (4) structural features, have a higher cross direction stiffness than prior art structures employing the same yarn types/diameter, same paper side FSI, and very similar amount of wear side cross-machine direction material, but employing interchanging binder yarn pairs between adjacent top weft yarns, wherein the yarns of each interchanging binder yarn pair provides a continuous weft path in each weave repeat.

The embodiments of the invention have been shown with an equal number of warp yarns in each layer, however, the benefits of the invention can also be obtained in fabrics with a different number of warp yarns in each layer. Similarly, although the binder yarns have been shown as cross-machine-direction weft yarns it is a straightforward matter for those skilled in the art to utilize the teachings of this invention to make structures wherein the path of the binder yarns is in the machine direction i.e. the binder yarns are warp yarns. However, in the most preferred embodiments of this invention the interchanging binder yarn pairs are weft yarns extending in the cross-machine-direction of movement of the fabric on a web forming machine.

The yarns used in the invention may be chosen from the range well known to those skilled in the art and include yarns of polyester and polyamide for example. Yarns can be multi or mono-filament and in the latter case the yarn cross section may be circular, ovate, square or otherwise profiled.

Without further elaboration, the foregoing will so fully illustrate my invention that others may, by applying current or future knowledge, readily adopt the same for use under various conditions of service.

What we claim as our invention is the following:

1. A composite fabric comprising a paper side layer having a paper side surface, a machine side layer having a bottom wear side surface, said paper side layer and said machine side layer comprising warp yarns and weft yarns woven together, each having a predetermined repeat of the weave pattern in the cross-machine-direction, and a plurality of pairs of first and second intrinsic, interchanging yarns having at least two segments in the paper side layer within each repeat of the weave pattern, wherein:

said first and second intrinsic, interchanging yarns in at least some of said plurality of pairs of first and second intrinsic, interchanging yarns cooperating to provide a discontinuous weft path in the paper side layer within each repeat of the weave pattern; each pair of interchanging yarns that provides a discontinuous weft path in the paper side layer being positioned between two adjacent top weft yarns of said paper side layer, said two adjacent top weft yarns having a weave pattern with the top warp yarns of the paper side layer such that one of the two adjacent top weft yarns cooperates with said first intrinsic, interchanging yarn of the adjacent pair of interchanging binder yarns that provides a discontinuous weft path to define a continuous weft path within each repeat of the weave pattern of the fabric, and the other of the two adjacent top weft yarns being located on the other side of the adjacent pair of interchanging yarns that provides a discontinuous weft path and cooperating with the second interchanging yarn of that adjacent pair of interchanging yarns to define a continuous weft path within each repeat of the weave pattern.

2. The composite fabric of claim 1, wherein at least some of the intrinsic interchanging yarns providing a discontinuous weft path provide at least a portion of the discontinuous weft path by overlapping with one or more of the same top warp yarns.

3. The composite fabric of claim 1, wherein at least some of the intrinsic interchanging yarns providing a discontinuous weft path in the paper side layer provide at least a portion the discontinuous weft path by having discontinuities in the weave pattern created by at least two adjacent top warp yarns being disposed between adjacent paper side segments provided by intrinsic, interchanging yarns.

4. The composite fabric of claim 1, wherein said first and second intrinsic, interchanging yarns cooperating to provide a discontinuous weft path in the paper side layer within each repeat of the weave pattern are intrinsic, interchanging binder yarn pairs.

5. The composite fabric of claim 1, wherein the continuous weave pattern provided by the cooperation of the pairs of first and second intrinsic interchanging yarns that provide a discontinuous weft path in the paper side layer with the adjacent top weft yarns is a plain weave pattern.

6. The composite fabric of claim 1, including top weft yarns in each repeat that are not disposed adjacent a pair of first and second intrinsic interchanging yarns that provide a discontinuous weft path in the paper side layer.

7. The composite fabric of claim 1, wherein the ratio of top weft paths to bottom weft paths is 1:1.

8. The composite fabric of claim 1, wherein the ratio of top weft paths to bottom weft paths is greater than 1:1.

9. The composite fabric of claim 8, wherein the ratio of top weft paths to bottom weft paths is either 2:1; 3:2; 4:3 or 3:1.

10. The composite fabric of claim 1, being a forming fabric for use in a papermaking machine.

11. The composite fabric of claim 1, wherein said at least two segments in the paper side layer provided by first and second interchanging yarns of at least one pair of such interchanging yarns are either of equal or unequal lengths.

12. The composite fabric of claim 1, wherein first and second interchanging yarns of at least one pair of such yarns interlace with an equal or unequal number of wear side warp yarns within each repeat of the weave pattern.

13. The composite fabric of claim 1, wherein first and second interchanging yarns of at least one pair of such interchanging yarns interlace with an unequal number of wear side warp yarns and the yarns so interlaced are either adjacent to or spaced apart from each other.

* * * * *